US008123546B2

(12) United States Patent
Suzuki et al.

(10) Patent No.: US 8,123,546 B2
(45) Date of Patent: Feb. 28, 2012

(54) CONNECTOR FOR LARGE POWER TRANSMISSION

(75) Inventors: Sachio Suzuki, Hitachi (JP); Hideaki Takehara, Hitachi (JP); Kunihiro Fukuda, Tsukuba (JP); Yuta Kataoka, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 9 days.

(21) Appl. No.: 12/850,255

(22) Filed: Aug. 4, 2010

(65) Prior Publication Data

US 2011/0189883 A1 Aug. 4, 2011

(30) Foreign Application Priority Data

Feb. 1, 2010 (JP) ..... 2010-020687

(51) Int. Cl.
*H01R 13/62* (2006.01)
*H01R 13/64* (2006.01)

(52) U.S. Cl. ..... 439/372; 439/157; 439/346

(58) Field of Classification Search ..... 439/372, 439/157, 346, 359, 296
See application file for complete search history.

(56) References Cited

U.S. PATENT DOCUMENTS

| | | | | |
|---|---|---|---|---|
| 3,504,100 | A * | 3/1970 | Keiji et al. | 174/88 B |
| 7,892,038 | B1 * | 2/2011 | Kataoka et al. | 439/660 |
| 7,922,518 | B1 * | 4/2011 | Takehara et al. | 439/485 |
| 7,955,110 | B1 * | 6/2011 | Kataoka et al. | 439/284 |
| 7,959,470 | B1 * | 6/2011 | Umetsu et al. | 439/626 |
| 7,980,879 | B2 * | 7/2011 | Suzuki et al. | 439/346 |
| 7,985,092 | B2 * | 7/2011 | Suzuki et al. | 439/346 |
| 2009/0075506 | A1 | 3/2009 | Suzuki | |
| 2011/0130023 | A1 * | 6/2011 | Kataoka et al. | 439/271 |
| 2011/0130028 | A1 * | 6/2011 | Takehara et al. | 439/485 |
| 2011/0159717 | A1 * | 6/2011 | Umetsu et al. | 439/296 |
| 2011/0159728 | A1 * | 6/2011 | Suzuki et al. | 439/587 |
| 2011/0159729 | A1 * | 6/2011 | Suzuki et al. | 439/587 |
| 2011/0159731 | A1 * | 6/2011 | Kataoka et al. | 439/604 |
| 2011/0189891 | A1 * | 8/2011 | Suzuki et al. | 439/607.01 |
| 2011/0250770 | A1 * | 10/2011 | Suzuki et al. | 439/157 |
| 2011/0250771 | A1 * | 10/2011 | Suzuki et al. | 439/157 |
| 2011/0250801 | A1 * | 10/2011 | Kataoka et al. | 439/668 |

FOREIGN PATENT DOCUMENTS

| | | |
|---|---|---|
| JP | A-2004-056924 | 2/2004 |
| JP | B2-4037199 | 11/2007 |
| JP | A-2009-70754 | 4/2009 |

* cited by examiner

*Primary Examiner* — Hae Moon Hyeon
(74) *Attorney, Agent, or Firm* — Scully, Scott, Murphy & Presser, PC

(57) ABSTRACT

A connector includes a male terminal housing with a plurality of first connecting terminals aligned and accommodated therein, a female terminal housing with a plurality of second connecting terminals aligned and accommodated therein, a plurality of isolating plates aligned and accommodated in the male terminal housing, a connecting member, and a lever mechanism including a lever to rotate a head of the connecting member so as to press the head of the connecting member against the adjacent one of the plurality of insulation plates. The lever mechanism further includes an operation permitting means that permits the connecting member to collectively fix the plurality of first connecting terminals and the plurality of second connecting terminals at the contacts, when the male terminal housing and the female terminal housing are in a predetermined fitting state.

7 Claims, 8 Drawing Sheets

5 MALE TERMINAL HOUSING
7 FEMALE TERMINAL HOUSING
9 CONNECTING MEMBER
9b HEAD
52 LEVER

5 MALE TERMINAL HOUSING
7 FEMALE TERMINAL HOUSING
9 CONNECTING MEMBER
9b HEAD
52 LEVER

5 MALE TERMINAL HOUSING
9 CONNECTING MEMBER
9b HEAD
52 LEVER

5 MALE TERMINAL HOUSING
59 FIRST ROTATION PREVENTING RIB
61 LEVER ENGAGING RIB
63 DISENGAGEMENT PREVENTING RIB

62 ENGAGEMENT RELEASING RIB
64 LOCKING MECHANISM
66 SECOND ROTATION PREVENTING RIB

52 LEVER 59 FIRST ROTATION PREVENTING RIB
58 LANCE

| | |
|---|---|
| 52 LEVER | 59 FIRST ROTATION PREVENTING RIB |
| 58 LANCE | 61 LEVER ENGAGING RIB |
| | 63 DISENGAGEMENT PREVENTING RIB |

| | |
|---|---|
| 52 LEVER | 61 LEVER ENGAGING RIB |
| 58 LANCE | 62 ENGAGEMENT RELEASING RIB |
| | 63 DISENGAGEMENT PREVENTING RIB |

CONNECTOR FOR LARGE POWER TRANSMISSION

The present application is based on Japanese patent application No. 2010-020687 filed on Feb. 1, 2010, the entire contents of which are incorporated herein by reference.

BACKGROUND OF THE INVENTION

1. Field of the Invention

The present invention relates to a connection structure, for use in eco-friendly cars, such as hybrid vehicles, electric vehicles and the like, and in particular, for being capable of use for a portion to connect a power harness, which is used for large power transmission.

2. Description of the Related Art

In hybrid vehicles, electric vehicles and the like which have remarkably developed in recent years, a power harness, which is used for large power transmission for connection between devices, has at its one end a connector, which consists of two separate portions: a male connector portion with a male terminal and a first terminal housing accommodating that male terminal, and a female connector portion with a female terminal connected with the male terminal and a second terminal housing accommodating that female terminal (See, e.g., JP-A-2009-70754)

In recent years, such eco-friendly cars have been designed to reduce the weights of all parts thereof, to enhance the energy saving performance of the cars. As one effective means to reduce the weights of parts of the cars, it has been proposed to reduce the sizes of the parts.

For example, a technique as described below, which has been disclosed by JP patent No. 4037199, is known in the art.

JP patent No. 4037199 discloses an electrical connection structure for a vehicle, which is for connecting multiphase connecting terminals of a conductive member drawn out from a motor for driving the vehicle, and multiphase connecting terminals of a power line cable drawn out from an inverter for driving the motor. The technique used in the electrical connection structure disclosed by JP patent No. 4037199 is as follows: Each phase connecting terminal of the conductive member and each corresponding phase connecting terminal of the power line cable are overlapped, and isolating members are disposed on opposite surfaces to the overlapped surfaces of the connecting terminals, respectively, and these overlapped connecting terminals and isolating members are collectively fastened in an overlapping direction with a single bolt provided in a position to penetrate these overlapped connecting terminals and isolating members.

That is, in the technique used in the electrical connection structure disclosed by JP patent No. 4037199, the single bolt is tightened in the overlapping direction, to collectively hold the multiplicity of contacts between the connecting terminals, which are the overlapped surfaces of the connecting terminals, and thereby fix the connecting terminals at the contacts therebetween, for electrical connections between the connecting terminals, respectively. The construction disclosed by JP patent No. 4037199 is effective in easily ensuring size reduction, compared to a technique disclosed by JP-A-2009-070754.

However, the construction as disclosed in JP patent 4037199 may cause a problem described below.

In other words, the construction as disclosed in JP patent 4037199 allows the fastening by the bolt even when the connecting terminals fail to be inserted at a predetermined position. Because of this, failure in electrical connection may be caused. Especially, in case of the power harness used for large power transmission, it is necessary to eliminate the failure in electrical connection in terms of safety. Thus, an effective countermeasure has been desired for solving the above problem.

SUMMARY OF THE INVENTION

Therefore, it is an object of the invention to provide a connector that includes a connection structure with plural first connecting terminals, plural second connecting terminals and plural insulation plates arranged in a stacked state and is unlikely to cause an electrical connection failure by constructing such that its contacts cannot be easily fastened together by its connecting member except when the connecting terminals are mutually at a predetermined position.

(1) According to one embodiment of the invention, a connector comprises:

a male terminal housing with a plurality of first connecting terminals aligned and accommodated therein;

a female terminal housing with a plurality of second connecting terminals aligned and accommodated therein;

a plurality of isolating plates aligned and accommodated in the male terminal housing, wherein when the male terminal housing and the female terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of isolating plates;

a connecting member comprising a head, the head being adapted to press an adjacent one of the plurality of isolating plates for collectively fixing the plurality of first connecting terminals and the plurality of second connecting terminals at contacts for electrical connections between the plurality of first connecting terminals and the plurality of second connecting terminals, respectively; and a lever mechanism comprising a lever to rotate the head of the connecting member so as to press the head of the connecting member against the adjacent one of the plurality of insulation plates, wherein the lever mechanism further comprises an operation permitting means that permits the connecting member to collectively fix the plurality of first connecting terminals and the plurality of second connecting terminals at the contacts, when the male terminal housing and the female terminal housing are in a predetermined fitting state.

In the above embodiment (1) of the invention, the following modifications and changes can be made.

(i) The plurality of first connecting terminals and the plurality of second connecting terminals are collectively fixed at the contacts by rotating the lever from a releasing position to a fixing position in one rotation direction, and the operation permitting means comprises:

a lever engaging rib on the male terminal housing;

a lance on the lever to engage with the lever engaging rib at the releasing position so as to prevent the lever from rotating from the releasing position in the one rotation direction, when the male terminal housing and the female terminal housing are not in the predetermined fitting state; and an engagement releasing rib on the female terminal housing to push up the lance engaged with the lever engaging rib so as to release the engagement between the lever engaging rib and the lance to permit the lever to rotate from the releasing position to the fixing position in the one rotation direction, when the male terminal housing and the female terminal housing are in the predetermined fitting state.

(ii) The lever comprises a first rotation preventing rib to contact the lever engaging rib at the releasing position so as to prevent the lever from rotating from the releasing position in an other rotation direction.

(iii) The female terminal housing comprises a second rotation preventing rib to contact the lever at the fixing position so as to prevent the lever from rotating from the fixing position in the one rotation direction.

(iv) The female terminal housing comprises a locking mechanism to fix the lever at the fixing position.

(v) The lever comprises a plate-like member to rotate integrally with the connecting member, and is disposed on one side of the male terminal housing rotatable around the connecting member as a rotation axis.

(vi) The male terminal housing comprises a disengagement preventing rib to contact a surface of the lever opposite to the male terminal housing so as to prevent the lever and the connecting member from disengaging from the male terminal housing.

Points of the Invention

According to one embodiment of the invention, a connector is constructed such that the fastening operation of a connecting member by a lever mechanism is not permitted when the fitting of connector parts is incomplete, and the fastening operation of the connecting member by the lever mechanism is permitted only when the fitting of the connector parts is completed. Thereby, the connection failure between the first connecting terminals and the second connecting terminals can be prevented.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1A:
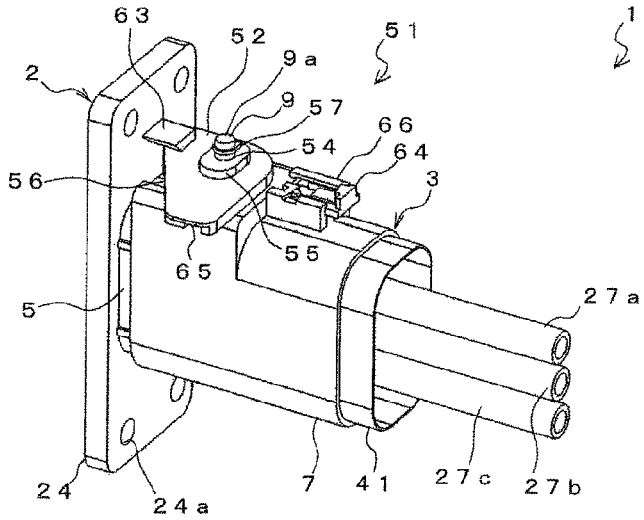
FIG. 1A is a perspective view schematically showing a connector when a lever is located at a releasing position according to one embodiment of the invention.

The preferred embodiments according to the invention will be explained below referring to the drawings.

Figure 1B:
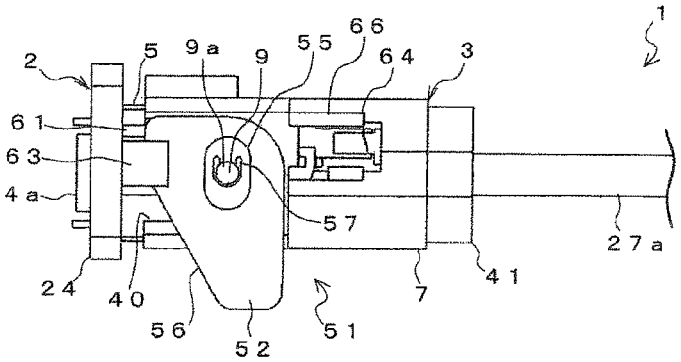
FIG. 1B is a top view schematically showing a connector when a lever is located at a releasing position according to one embodiment of the invention.
Figure 1C:
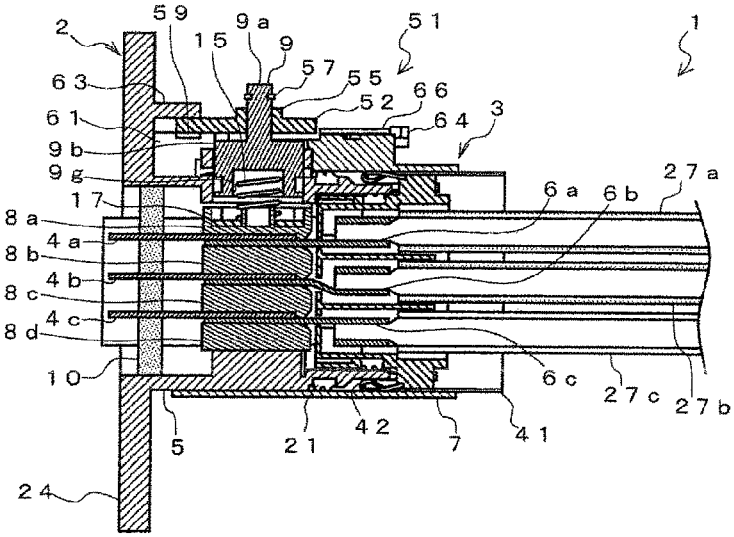
FIG. 1C is a cross-sectional side view schematically showing a connector when a lever is located at a releasing position according to one embodiment of the invention.
Figure 2A:
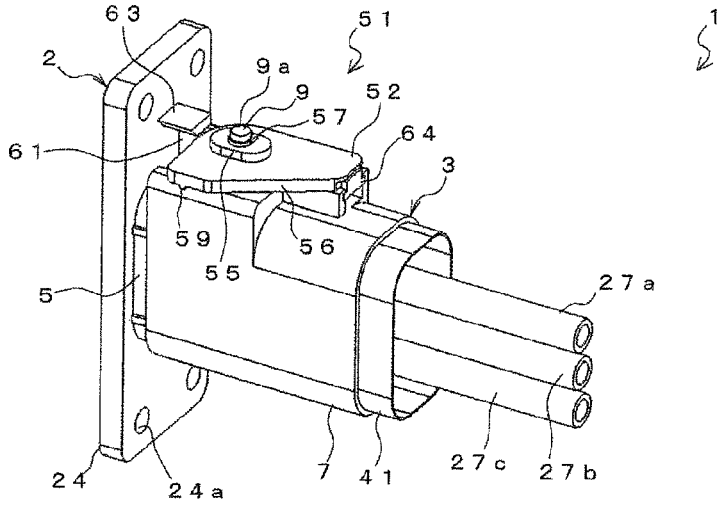
FIG. 2A is a perspective view schematically showing a connector when a lever is located at a fixing position in FIG. 1A.
Figure 2B:
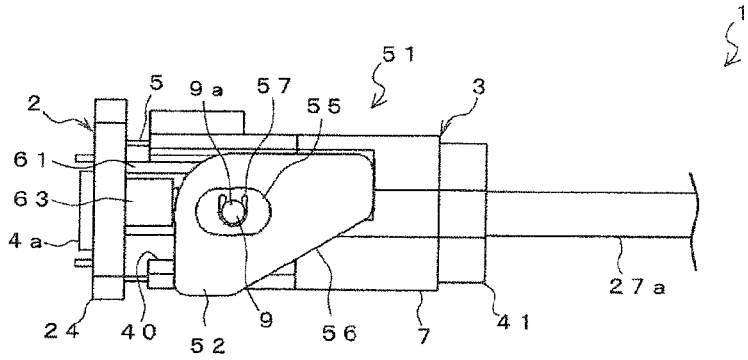
FIG. 2B is a top view schematically showing a connector when a lever is located at a fixing position in FIG. 1B.
Figure 2C:
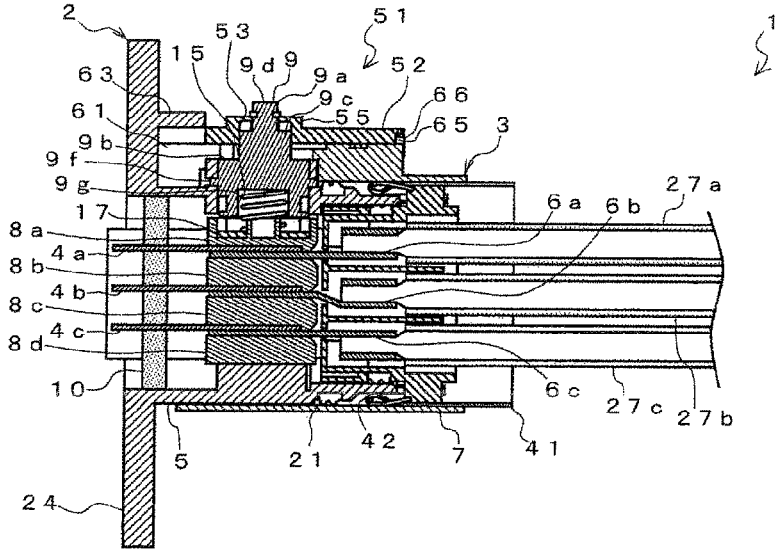
FIG. 2C is a cross-sectional side view schematically showing a connector when a lever is located at a fixing position in FIG. 1C.

FIG. 1A is a perspective view schematically showing a connector when a lever is located at a releasing position according to one embodiment of the invention, FIG. 1B is a top view schematically showing a connector when a lever is located at a releasing position according to one embodiment of the invention, FIG. 1C is a cross-sectional side view schematically showing a connector when a lever is located at a releasing position according to one embodiment of the invention, FIG. 2A is a perspective view schematically showing a connector when a lever is located at a fixing position in FIG. 1A, FIG. 2B is a top view schematically showing a connector when a lever is located at a fixing position in FIG. 1B, and FIG. 2C is a cross-sectional side view schematically showing a connector when a lever is located at a fixing position in FIG. 1C.

As shown in FIGS. 1A to 1C and FIGS. 2A to 2C, a connector 1 according to the embodiment includes a first connector part 2 and a second connector part 3 and is used for collectively connecting a plurality of power-supply lines by allowing the connector parts 2, 3 to be fitted to each other.

More particularly, the connector 1 includes the first connector part 2 having a male terminal housing 5 in which a plurality of (three) first connecting terminals (male terminals) 4*a* to 4*c* are housed in alignment with each other, the second connector part 3 having a female terminal housing 7 in which a plurality of (three) second connecting terminals (female terminals) 6*a* to 6*c* are housed in alignment with each other and a plurality of insulation plates 8*a* to 8*d* housed in the male terminal housing 5 in alignment with each other, and the connector 1 has a composition that when the male terminal housing 5 of the first connector part 2 and the female terminal housing 7 of the second connector part 3 are fitted to each other, each of a plurality of the first connecting terminals 4*a* to 4*c* and each of a plurality of the second connecting terminals 6*a* to 6*c* face each other so that they form a pair with each other (each pair of the first connecting terminal 4*a* and the second connecting terminal 6*a*, the first connecting terminal 4*b* and the second connecting terminal 6*b*, and the first connecting terminal 4*c* and the second connecting terminal 6*c*), and a plurality of the insulation plates 8*a* to 8*d* is arranged so as to sandwich a plurality of the first connecting terminals 4*a* to 4*c* and a plurality of the second connecting terminals 6*a* to 6*c* that form pairs with each other, so that a stacked state is formed. Namely, the connector 1 according to the embodiment is such that when the male terminal housing 5 of the first connector part 2 and the female terminal housing 7 of the second connector part 3 are fitted to each other, a plurality of the first connecting terminals 4*a* to 4*c*, a plurality of the second connecting terminals 6*a* to 6*c* and a plurality of the insulation plates 8*a* to 8*d* are arranged so as to form the stacked state with each other.

The connector 1 is used for, for example, connection between a vehicle drive motor and an inverter which drives the motor.

More particularly, the male terminal housing 5 (i.e., a part on the left side in FIG. 1C) of the first connector part 2 is fitted to a shield case of the motor, and a portion of the first connecting terminals 4*a* to 4*c* exposed from the male terminal housing 5 is connected to each terminal in a terminal block installed in the shield case of the motor. The second connector part 3 that electrically connects to the inverter is fitted to the first connector part 2, so that the motor and the inverter are connected to each other. In the above, a case of connection in the motor side has been explained, but a case of connection in the inverter side is similar to the case of the motor side.

Hereinafter, each composition of the first connector part 2 and the second connector part 3 will be explained in detail.

First Connector Part

The first connector part 2 will be explained below.

Figure 3A:
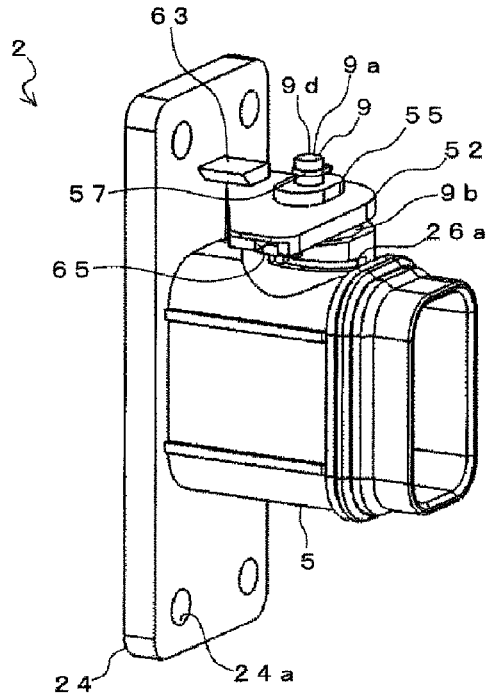
FIG. 3A is a perspective view schematically showing a first connector part in FIG. 1A.
Figure 3B:
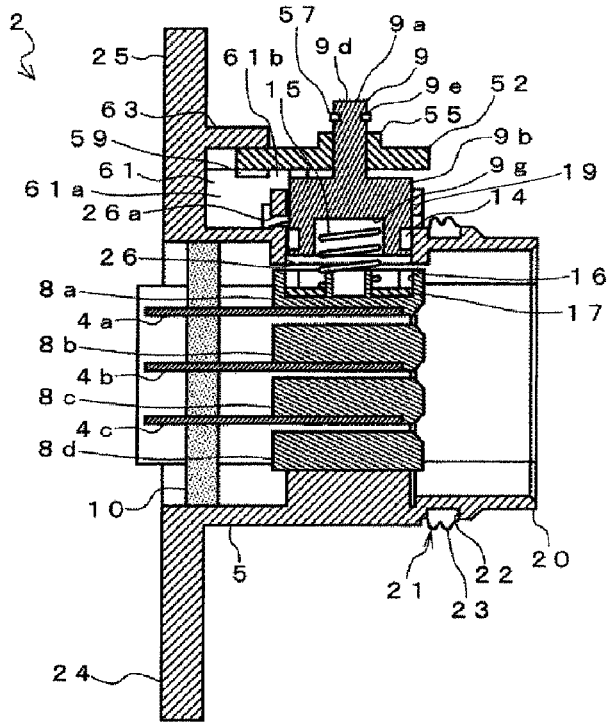
FIG. 3B is a cross-sectional side view schematically showing a first connector part in FIG. 1C.

As shown in FIGS. 3A and 3B, the first connector part 2 internally holds three first connecting terminals 4*a* to 4*c* located apart at certain intervals in alignment with each other, and has the male terminal housing 5 in which three first connecting terminals 4*a* to 4*c* are housed in alignment with each other, a plurality of insulation plates 8*a* to 8*d* for insulating each of the first connecting terminals 4*a* to 4*c*, that are installed in the male terminal housing 5 and have a nearly rectangular parallelepiped shape, and a connecting member 9 that has a head part 9*b*, and collectively fixes and electrically connects a plurality of the first connecting terminals 4*a* to 4*c* and a plurality of the second connecting terminals 6*a* to 6*c* at each contact by pressing the insulation plate 8*a* adjacent to the head part 9*b* by using the head part 9*b*.

The first connecting terminals 4*a* to 4*c* are respectively a plate-like terminal, are formed of a nonconductive resin such as polyphenylene sulfide (PPS) resin, polyphthalamide (PPA) resin, polyamide (PA) resin, polybutylene terephthalate (PBT) resin, epoxy based resin, and are held in a resin compact 10 that is a part of the male terminal housing 5 so as to be located apart at certain intervals in alignment with each other. A method of allowing the resin compact 10 to hold the first connecting terminals 4*a* to 4*c* includes, for example, a method of inserting the first connecting terminals 4*a* to 4*c* into the resin at the time of molding the resin compact 10 and then hardening the resin so as to allow the resin compact 10 to hold the first connecting terminals 4*a* to 4*c* and a method of pressing the first connecting terminals 4*a* to 4*c* into the resin compact 10 that is preliminarily molded so as to allow the resin compact 10 to hold the first connecting terminals 4*a* to 4*c*.

Electricity of different voltage and/or different current transmits to each of the first connecting terminals 4*a* to 4*c*. For example, in the embodiment, a power line of three-phase alternating current used for a connection between a motor and an inverter is assumed, and an alternating current having different phases by 120 degrees is transmitted to each of the first connecting terminals 4*a* to 4*c*. For the purpose of transmission loss reduction at the connector 1 and the like, it is preferable that each of the first connecting terminals 4*a* to 4*c* is formed of metal having high electric conductivity such as silver, copper, aluminum. In addition, each of the first connecting terminals 4*a* to 4*c* has a certain degree of flexibility.

Plural insulation plates 8*a* to 8*d* include a plurality of the first insulation plates 8*a* to 8*c* housed in the male terminal housing 5 in alignment with each other and integrally fixed to each of one surfaces (i.e., surfaces opposite to the surfaces to be bonded to the second connecting terminals 6*a* to 6*c*) of the first connecting terminals 4*a* to 4*c*, and the second insulation plate 8*d* installed so as to be integrally fixed in an inner surface of the male terminal housing 5, and simultaneously disposed so as to face one surface (i.e., a surface opposite to the surface to be bonded to the first connecting terminal 4*c*) of the second connecting terminal 6*c* that locates at the outermost position when a plurality of the first connecting terminals 4*a* to 4*c* and a plurality of the second connecting terminals 6*a* to 6*c* are stacked.

Plural insulation plates 8*a* to 8*d* are fixed in such a position that they project in a side of the forward ends of the first connecting terminals 4*a* to 4*c*. Each of the insulation plates 8*a* to 8*d* are chamfered at each of the corners located at the side into/from which the second connecting terminals 6*a* to 6*c* are inserted/removed.

Figure 4A:
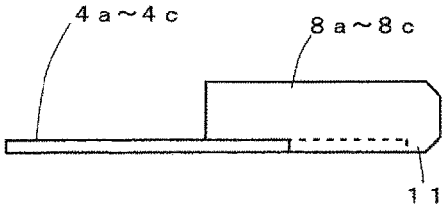
FIG. 4A is a side view schematically showing a first connecting terminal in first connector part in FIGS. 3A and 3B.
Figure 4B:
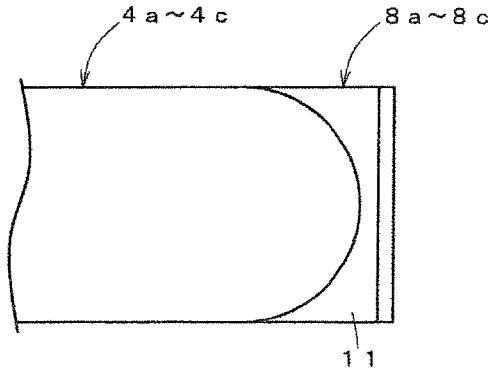
FIG. 4B is a bottom view schematically showing a first connecting terminal in first connector part in FIGS. 3A and 3B.

In addition, as shown in FIGS. 4A and 4B, a projection part (i.e., a deposit surface) 11 for making up steps formed between the first connecting terminals 4*a* to 4*c* is formed in each of surfaces of a plurality of the first insulation plates 8*a* to 8*c* that are fixed to the first connecting terminals 4*a* to 4*c*, so that a plurality of the lower surfaces (i.e., surfaces shown on the lower side in the drawings) of the first insulation plates 8*a* to 8*c* are formed so as to become in flush with the lower surfaces (i.e., surfaces shown on the lower side in the drawings) of the first connecting terminals 4*a* to 4*c*. Due to these compositions, an advantage that insertion properties of the second connecting terminals 6*a* to 6*c* can be enhanced can be provided, since the forward end parts of the first connecting terminals 4*a* to 4*c* do not come into contact with the forward end parts of the second connecting terminals 6*a* to 6*c* that are inserted into the first connecting terminals 4*a* to 4*c*, when the first connector part 2 and the second connector part 3 are fitted to each other. Further, in FIG. 4A, the first insulation plate 8*a* is shown by simplifying the structure thereof and the first insulation plates 8*a* to 8*c* are shown in the same fashion.

Once again, referring to FIGS. 3A and 3B, the connecting member 9 has a head part 9*b* having a columnar shape as a pressing part for pressing the first insulation plate 8*a* adjacent thereto, and a lever mounting part 9*a* integrally formed with the head part 9*b*, that projects upward from a surface (hereinafter, referred to as merely "upper surface") of the head part 9*b* opposite to the first insulation plate 8*a*.

It is preferable that the connecting member 9 is formed of a metal material such as Stainless Use Steel (SUS), iron, copper alloy. Further, the connecting member 9 formed of a resin material may be also used, but it is preferable to use the connecting member 9 formed of the metal material in terms of strength.

Figure 9:
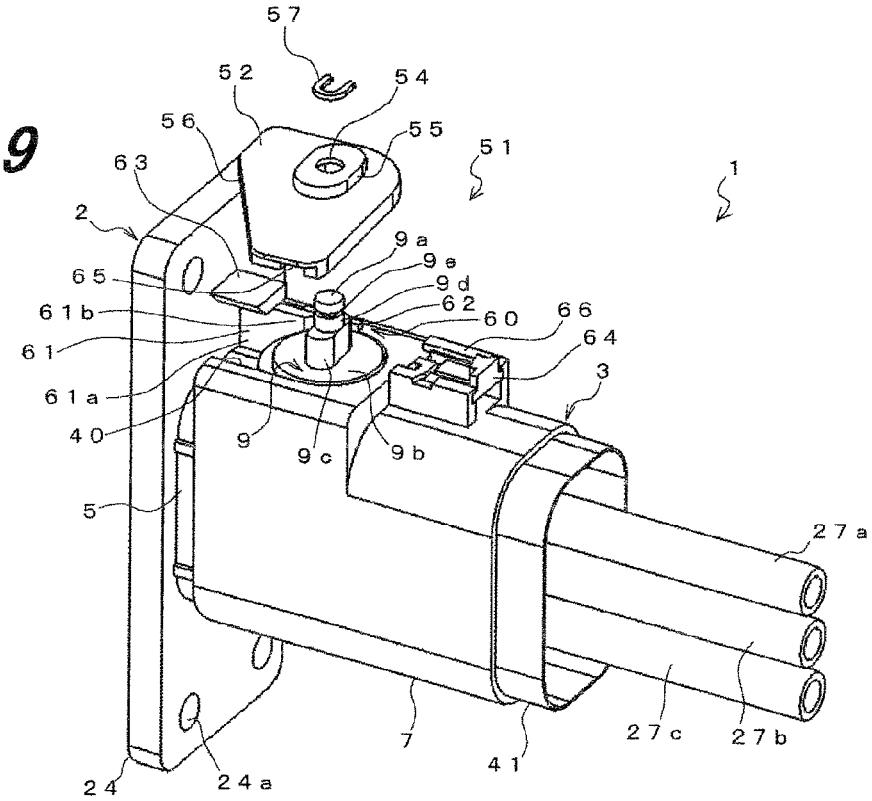
FIG. 9 is an exploded perspective view of the connector shown in FIG. 1A.

The lever mounting part 9*a* includes a base end part 9*c* having an oval shape in a cross-section, the oval shape being a shape that two straight lines being in parallel are respectively connected to each other at the corresponding edge parts thereof by two carved lines of a circular shape, that projects upward from an almost center part of the upper surface of the head part 9*b*, and a shaft part 9*d* having a columnar shape, that projects further upward from the base end part 9*c* (refer to FIG. 9). The shaft part 9*d* has a groove 9*e* in which a C-ring 57 is fitted, that is formed along a circumferential direction.

Figure 5:
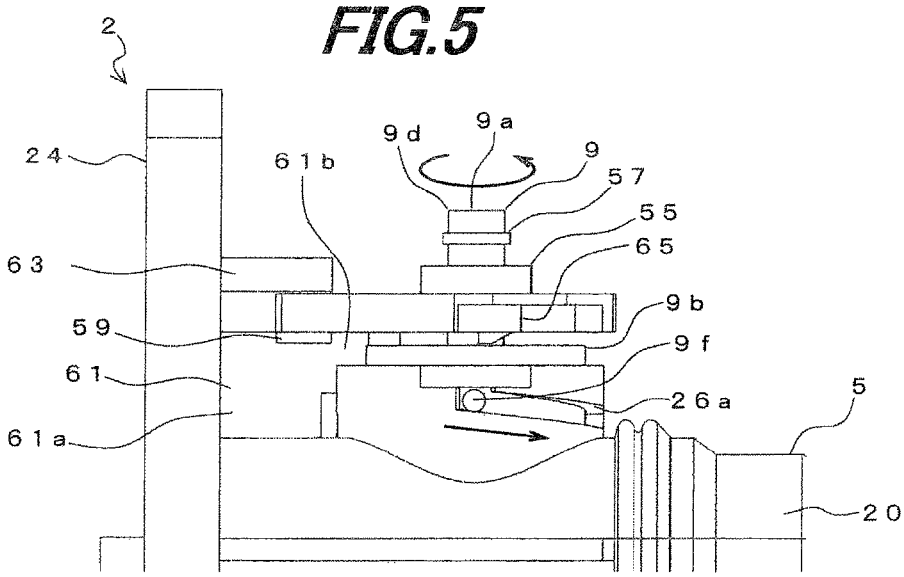
FIG. 5 is an enlarged side view of the essential parts of the first connector part shown in FIGS. 3A and 3B, explaining that a projection formed in a head part of the connecting member is guided by a spiral groove.

The head part 9*b* is formed so as to have a columnar shape, and has two projections 9*f* projecting outward in a radial direction, that is formed in the side surface thereof (refer to FIGS. 2C and 5). The two projections 9*f* are formed at opposite locations to each other in the side surface of the head part 9*b*. The two projections 9*f* is inserted into a spiral groove 26*a* of a connecting member insertion hole described below.

At the periphery of the head part 9*b* of the connecting member 9, a packing 14 for preventing water from entering into the male terminal housing 5 is installed. In addition, an elastic member 15 is installed between a lower surface of the head part 9*b* of the connecting member 9 and an upper surface of the first insulation plate 8*a* arranged directly below the head part 9*b*, the elastic member 15 being used for applying a predetermined pressing force to the first insulation plate 8*a*. In the embodiment, a composition is adopted, that a concave portion 9*g* is formed in a lower surface of the head part 9*b* and an upper part of the elastic member 15 is housed in the concave portion 9*g*. This is a device to downsize the connector 1 by shortening a distance between the head part 9*b* and the first insulation plate 8*a*, even if the elastic member 15 has a length that is long to some extent. The elastic member 15 is formed of, for example, a spring of metal such as SUS. Further, in embodiment, the elastic member 15 is positioned as a part of the connecting member 9.

In an upper surface of the first insulation plate 8*a* with which the lower portion of the elastic member 15 contacts, a concave portion 16 covering (housing) the lower portion of the elastic member 15 is formed, and in a bottom portion of the concave portion 16 (i.e., a seat portion with which the lower portion of the elastic member 15 contacts), a receiving member 17 of metal such as SUS is installed, the receiving member 17 being used for receiving the elastic member 15 and preventing the first insulation plate 8*a* formed of an insulating resin from being damaged.

The receiving member 17 prevents the damage of the first insulation plate 8*a* by dispersing stress applied to the upper surface of the first insulation plate 8*a* from the elastic member 15. Consequently, it is preferable that a contact area of the receiving member 17 and the first insulation plate 8*a* is formed so as to be as large as possible. In the embodiment, in order to increase the contact area of the receiving member 17 and the first insulation plate 8*a*, the receiving member 17 having a shape that it contacts over the entire bottom surface of the concave portion 16 is installed.

The male terminal housing 5 is formed of a hollow tubular body 20 having a cross-section of nearly rectangular shape. An outer peripheral part on one end side (i.e., on the right side in FIG. 3B) of the tubular body 20 fitted to the female terminal housing 7 is formed to have a tapered form, in terms of the fitting capabilities to the second connector part 3. Also, in the outer peripheral part in one end side of the tubular body 20, a terminal housing waterproof structure 21 for sealing between the first connector part 2 and the second connector part 3 is formed. The terminal housing waterproof structure 21 includes a concave portion 22 formed in an outer peripheral part in an opening side of the tubular body 20 and a packing 23 such as an O-ring formed in the concave portion 22.

On another end side (i.e., on the left side in FIG. 3B) of the tubular body 20, the resin compact 10 in which each of the first connecting terminals 4*a* to 4*c* is aligned and held is housed. In the outer peripheral part in another end side of the tubular body 20, a flange 24 for fixing the first connector part 2 to a case body such as a device, for example, a shield case of motor is formed. The flange 24 has mounting holes 24*a* at the four corners thereof, and is fixed to the case body such as a device by inserting a bolt (not shown) into the mounting holes 24*a*. In a peripheral edge part 25 of the flange 24, a packing or the like for sealing between the case body such as a device and the first connector part 2 can be installed. Further, the composition of the flange 24 is not base on the promise that the first connector part 2 is fixed to the case body such as a device, but the flange 24 can be installed in the second connector part 3 or it can be installed in both of the first connector part 2 and the second connector part 3. In addition, both of the first connector part 2 and the second connector part 3 may be free without being fixed to the case body such as a device.

In addition, the flange 24 is effective in enhancing radiation properties. Namely, due to forming the flange 24, the surface area of the male terminal housing 5 can be increased, and when heat (e.g., heat generated at each contact) generated in the first connector part 2 is dissipated exteriorly via the male terminal housing 5, the radiation properties can be enhanced.

It is preferable that the tubular body 20 is formed of metal such as aluminum having a high electric conductivity, a high heat conductivity and a light weight in terms of shield performance, radiation properties and reduction in weight, but it can be formed of a resin or the like. In case that the male terminal housing 5 is formed of an insulating resin, the second insulation plate 8*d* and the male terminal housing 5 can be integrally formed with the nonconductive resin. Further, in the embodiment, the tubular body 20 is formed of aluminum. As described above, the tubular body 20 is formed of aluminum so that an advantage that when the connecting member 9 is screwed to the threaded screw hole 19, it can be fastened more firmly in comparison with a case that the tubular body 20 is formed of an insulating resin can be obtained.

In the upper portion (on the upper side in FIG. 3B) of the tubular body 20, a connecting member insertion hole 26 into which the connecting member 9 is inserted is formed. The male terminal housing 5 in a circumferential edge of the connecting member insertion hole 26 is formed to have a tubular shape (i.e., a hollow tubular shape), and the spiral groove 26*a* of a spiral shape for guiding the projection 9*f* of the head part 9*b* of the connecting member 9 is formed so as to pass through the male terminal housing 5 of a tubular shape.

As shown in FIG. 5, the connecting member 9 is inserted into the male terminal housing 5 from the upper side in FIG. 5 (i.e., from the side of the surface of the first connecting terminals 4*a* to 4*c* to which the first insulation plates 8*a* to 8*c* are each fixed). When the head part 9*b* is rotated in a state that the projection 9*f* of the head part 9*b* is housed in the spiral groove 26*a*, the projection 9*f* is guided by the spiral groove 26*a*, the head part 9*b* is moved downward according to the rotation of the head part 9*b*, and the head part 9*b* of the connecting member 9 presses the first insulation plate 8*a* adjacent thereto via the elastic member 15 (i.e., the connecting member 9 presses it downward from the top in FIG. 3B), so that a plurality of the first connecting terminals 4*a* to 4*c* and a plurality of the second connecting terminals 6*a* to 6*c* can be collectively fixed and electrically connected to each other at each contact.

In the embodiment, a composition is adopted, that the head part 9*b* is inserted into the connecting member insertion hole 26 (i.e., the projection 9*f* is inserted into the spiral groove 26*a*), and then the head part 9*b* is rotated by 90 degrees in a counterclockwise direction in top view, so that a plurality of the first connecting terminals 4*a* to 4*c* and a plurality of the second connecting terminals 6*a* to 6*c* are collectively fixed to each other at each contact. Namely, in the connector 1, the head part 9*b* is rotated by 90 degrees, so that each contact can be fixed and released. Details will be explained later, but a state (i.e., a state shown in FIGS. 1A to 1C) that the connecting member 9 is inserted into the connecting member insertion hole 26 corresponds to a released position at which each contact is not fixed, and a state (i.e., a state shown in FIGS. 2A to 2C) that the head part 9*b* is rotated by 90 degrees from the released position corresponds to a fixed position at which each contact is collectively fixed.

Second Connector Part

The second connector part 3 will be explained below.

Figure 6A:
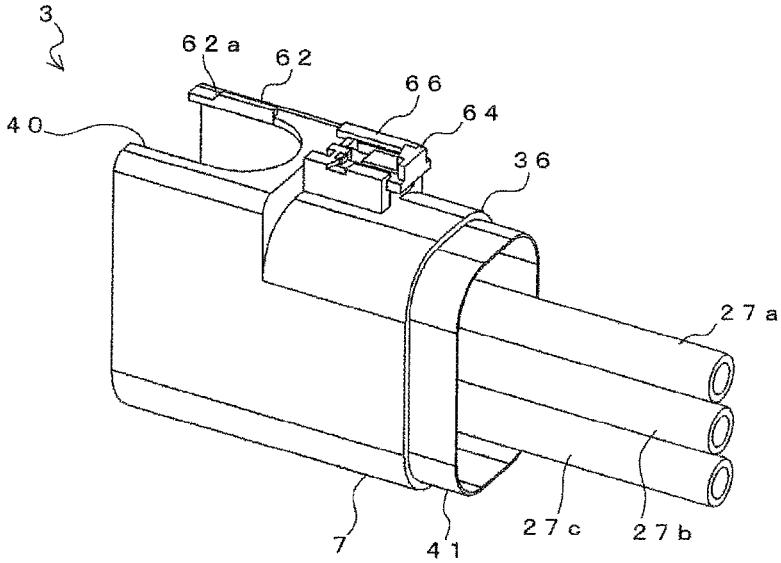
FIG. 6A is a perspective view schematically showing a second connector part in FIG. 1A.
Figure 6B:
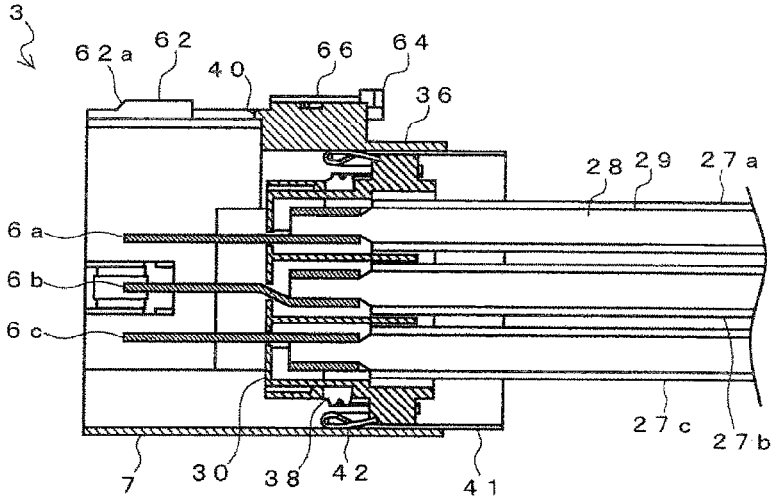
FIG. 6B is a cross-sectional side view schematically showing a second connector part in FIG. 1C.
Figure 7A:
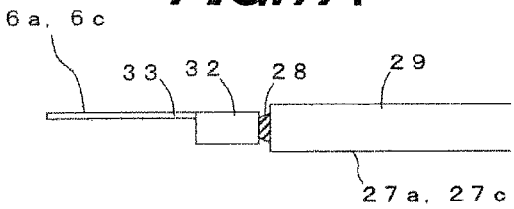
FIG. 7A is a side view schematically showing a second connecting terminal.
Figure 7B:
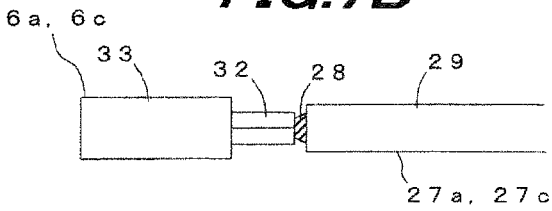
FIG. 7B is a bottom view schematically showing a second connecting terminal.

As shown in FIGS. 6A and 6B, the second connector part 3 includes a female terminal housing 7 in which a plurality of (three) second connecting terminals (female terminals) 6*a* to 6*c* are housed in alignment with each other.

Cables 27*a* to 27*c* extending from an inverter side are connected to each of one end sides of the second connecting terminals 6*a* to 6*c*. Each of the cables 27*a* to 27*c* is electrically connected to each of the first connecting terminals 4*a* to 4*c* via the second connecting terminals 6*a* to 6*c*, so that electricity of voltage and/or current corresponding to each of the first connecting terminals 4*a* to 4*c* is transmitted. Each of the cables 27*a* to 27*c* includes a conducting body 28 and an insulating layer 29 formed on an outer periphery of the conducting body 28. In the embodiment, the conducting body 28 having a surface area of 20 square mm is used.

Each of the cables 27*a* to 27*c* is held by a cable holding member 30 having a multiple tubular shape, namely a shape that a plurality of tubes are connected to each other, so as to be located apart at certain intervals in alignment with each other. By the cable holding member 30, when the first connector part 2 and the second connector part 3 are fitted to each other, each of the second connecting terminals 6*a* to 6*c* is positioned and held so as to be located below each of the first connecting terminals 4*a* to 4*c* that faces each of the second connecting terminals 6*a* to 6*c* so as to form a pair with each other (namely, that is an object to be connected).

The cable holding member 30 is formed of a nonconductive resin or the like in order to insulate each of the second connecting terminals 6*a* to 6*c* from each other and prevent it from short-circuiting. By the cable holding member 30, even if each of the cables 27*a* to 27*c* connected to each of the second connecting terminals 6*a* to 6*c* is excellent in flexibility, each of the second connecting terminals 6*a* to 6*c* can be held at a predetermined position. Namely, in the embodiment, a cable excellent in flexibility can be used as the cables 27*a* to 27*c*, so that degree of freedom of wiring when the cables 27*a* to 27*c* are laid can be increased.

Further, the cable holding member 30 carries out the positioning of the second connecting terminals 6*a* to 6*c* so as to hold the second connecting terminals 6*a* to 6*c* at a predetermined position by holding the cables 27*a* to 27*c*, particularly by holding end portion sides of the cables 27*a* to 27*c* that are adjacent to second connecting terminals 6*a* to 6*c*, but the positioning of the second connecting terminals 6*a* to 6*c* can be also carried out by holding the cables 27*a* to 27*c* and simultaneously holding second connecting terminals 6*a* to 6*c* directly. In addition, a connecting terminal holding member that does not hold the cables 27*a* to 27*c*, but holds the second connecting terminals 6*a* to 6*c* directly can be also used instead of the cable holding member 30.

With regard to the cable holding member 30, in the case of carrying out the positioning by holding the cables 27*a* to 27*c* instead of holding the second connecting terminals 6*a* to 6*c* directly, namely in the case of the embodiment, the cables 27*a* to 27*c* is formed of an flexible material so that the forward end sides of the second connecting terminals 6*a* to 6*c* can be formed to have a bendability to the female terminal housing 7. Due to the above-mentioned composition, in the first connector part 2, the first connecting terminals 4*a* to 4*c* are deformed by the pressing of the connecting member 9 and even if positions of the parts into which the second connecting terminals 6*a* to 6*c* are inserted are somewhat changed, a flexible response can be ensured.

In addition, a braided shield (not shown) for enhancing a shield performance is wrapped around the parts of the cables 27*a* to 27*c* that are pulled out of the female terminal housing 7. The braided shield contacts a tubular shield body 41 described below and is electrically connected (has identical potentials (GND)) to the male terminal housing 5 via the tubular shield body 41.

As shown in FIGS. 7A, 7B and 8A, 8B each of the second connecting terminals 6*a* to 6*c* includes a swaging part 32 for swaging the conductive body 28 exposed from the forward end parts of the cables 27*a* to 27*c* and a plate-like contact 33 integrally formed with the swaging part 32.

Figure 8A:
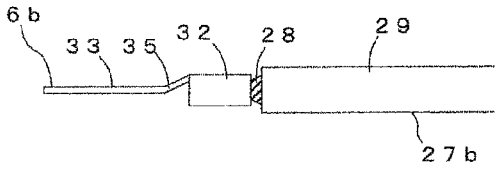
FIG. 8A is a side view schematically showing a second connecting terminal.
Figure 8B:
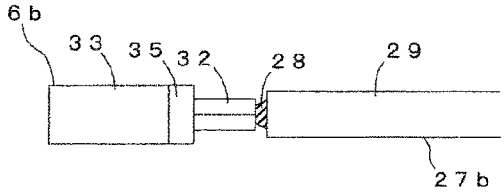
FIG. 8B is a bottom view schematically showing a second connecting terminal.

In the embodiment, in order to reduce the size of the connector 1, each of the cables 27*a* to 27*c* is formed so as to be aligned and held as tightly as possible. Consequently, as shown in FIGS. 8A and 8B, a body part 35 of the second connecting terminal 6*b* to be connected to the cable 27 *b* that is arranged in the center at the alignment is bent, so that the second connecting terminals 6*a* to 6*c* can be arranged so as to be located apart at the same intervals.

It is preferable that each of the second connecting terminals 6*a* to 6*c* is formed of metal such as silver, copper, aluminum having a high electric conductivity for the purpose of reducing transmission loss at the connector 1 or the like. In addition, each of the second connecting terminals 6*a* to 6*c* has some flexibility.

Referring to FIGS. 6A and 6B again, the female terminal housing 7 is formed of a hollow tubular body 36 having a cross-section of nearly rectangular shape. Since the male terminal housing 5 is fitted in the female terminal housing 7, an inner peripheral part on one end side (i.e., on the left side in FIG. 6B) of the tubular body 36 fitted to the male terminal housing 5 is formed so as to have a taper shape, in terms of the fitting capabilities to the male terminal housing 5.

The cable holding member 30 for aligning and holding each of the cables 27*a* to 27*c* is housed in another end side (i.e., on the right side in FIG. 6B) of the tubular body 36. A packingless air-tight part (not shown) is formed in a cable insertion side of the cable holding member 30 so as to prevent water from entering into the female terminal housing 7 through the cables 27*a* to 27*c*. A packing 38 that contacts the inner peripheral surface of the male terminal housing 5 is formed on the outer peripheral part of the cable holding member 30. Namely, the connector 1 is formed so as to have a double waterproof structure that includes the packing 23 of the terminal housing waterproof structure 21 and the packing 38 formed on the outer peripheral part of the cable holding member 30.

In addition to the above, the outer periphery of another side of the tubular body 36 out of which the cables 27*a* to 27*c* are pulled is covered with a rubber boot (not shown) so as to prevent water from entering into the tubular body 36.

Further, a cutting region 40 is formed at the upper portion (i.e., on the upper side in FIG. 6B) of the tubular body 36, the cutting region 40 being used for avoiding the connecting member 9 installed in the first connector part 2 when the second connector part 3 and the first connector part 2 are fitted to each other. The cutting region 40 is formed so as to have a U-letter shape, namely a part of the cutting region 40 located at a side of one edge of the tubular body 36 is opened, and when the second connector part 3 and the first connector part 2 are fitted to each other, the head part 9*b* of the connecting member 9 is housed in the cutting region 40.

It is preferable that the tubular body 36 is formed of metal such as aluminum having a high electric conductivity, a high heat conductivity and a light weight in terms of shield performance, radiation properties and reduction in weight of the connector 1, but it can be formed of a resin or the like. In the embodiment, the tubular body 36 is formed of an insulating resin, consequently, a tubular shield body 41 formed of aluminum is installed on an inner peripheral surface of another end side of the tubular body 36.

The tubular shield body 41 has a contact part 42 for contacting an outer periphery of the male terminal housing 5 formed of aluminum when the first connector part 2 and the second connector part 3 are fitted to each other, and is thermally and electrically connected to the male terminal housing 5 via the contact part 42. Due to this, shield performance and radiation properties can be enhanced. In particular, with regard to radiation properties, remarkable improvement is expected due to transferring heat aggressively to a side of the male terminal housing 5 excellent in radiation properties.

Lever Mechanism

The lever mechanism that is a characteristic point of the invention will be explained below.

As shown in FIG. 9, the connector 1 according to the embodiment includes a lever mechanism 51 that has a lever 52 for allowing the head part 9*b* of the connecting member 9 to be rotated, so as to allow the head part 9*b* of the connecting member 9 to press the first insulation plate 8*a* adjacent thereto.

The lever 52 is formed of a plate-like member that is rotated integrally with the connecting member 9 and is a so-called cantilever type lever that is disposed in one side of the male terminal housing 5 (FIG. 9 shows as an upper side) rotatably about the connecting member 9 as a rotation axis. The cantilever type lever is adopted as the lever 52, so that an occupied space of the lever 52 can be reduced and the whole of the connector 1 can be downsized in comparison with a so-called twin lever type lever that is supported by two rotation axes so as to sandwich the whole of the connector 1.

Figure 10A:
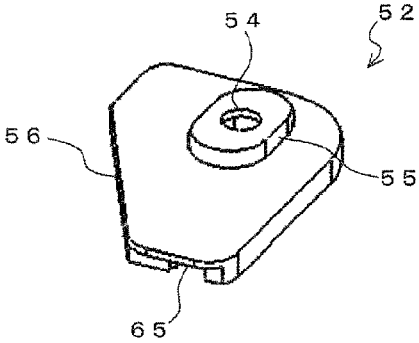
FIG. 10A is a perspective view schematically showing a lever in the connector shown in FIG. 1A, when viewed from a surface side.
Figure 10B:
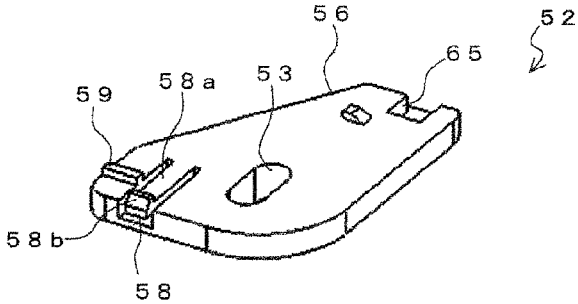
FIG. 10B is a perspective view schematically showing a lever in the connector shown in FIG. 1A, when viewed from a rear surface side.

As shown in FIGS. 10A and 10B, the lever 52 has a concave portion 53 of an oval shape formed in the rear surface thereof, into which the base end part 9*c* of the lever mounting part 9*a* is inserted, and the concave portion 53 has a through hole 54 formed in a bottom wall thereof, for allowing the shaft part 9*d* to pass through. In the embodiment, a composition is adopted, that a convex portion 55 is formed so as to project from a side of the surface of the lever 52 at a position of forming the concave portion 53 and the concave portion 53 is formed until inside of the convex portion 55, so that the concave portion 53 can have a deeper depth and the lever 52 can be firmly fitted to the base end part 9*c* of the lever mounting part 9*a*.

Further, the reason why the base end part 9*c* and the concave portion 53 are formed so as to have the oval shape is that a device is adopted, that the connecting member 9 can be rotated integrally with the lever 52 when the lever 52 is rotated, but the shapes of the base end part 9*c* and the concave portion 53 are not limited to the oval shape, any shape can be used if the lever 52 and the connecting member 9 can be rotated integrally with each other, and an arbitrary shape such as an elliptical shape, a polygonal shape can be used. In a groove 9*e* of the shaft part 9*d* projecting upward from the through hole 54 of the lever 52, a C-ring 57 for preventing the lever 52 from disengaging from the connecting member 9 is mounted.

The lever 52 is formed so as to have an almost rectangular shape whose four corners are rounded in top view, and the concave portion 53 and the through hole 54 are formed at a position that is a almost central position in a direction parallel to a short side of the rectangular shape (FIG. 10A shows as a direction from a right front side to a left rear side, hereinafter referred to as a short side direction) and a biased position to one side in a direction parallel to a long side of the rectangular shape (FIG. 10A shows as a direction from a left front side to a right rear side, hereinafter referred to as a long side direction). Namely, the shaft part 9*d* of the connecting member 9 that is used as a rotation axis of the lever 52 is mounted at a biased position to the lever 52 in the long side direction.

The connecting member 9 allows the lever 52 to be rotated from the releasing position shown in FIGS. 1A to 1C to the fixing position shown in FIGS. 2A to 2C by 90 degrees in one rotation direction (here, in the counterclockwise direction), and according to this, the head part 9*b* of the connecting member 9 is rotated by 90 degrees, so that a plurality of the first connecting terminals 4*a* to 4*c* and a plurality of the second connecting terminals 6*a* to 6*c* can be collectively fixed at each contact.

As shown in FIGS. 1A to 1C, at the releasing position, the lever 52 is formed so as to have a composition that the short side direction conforms to the fitting direction (FIG. 1B shows as the left-right direction), and the other end part in the long side direction (an end part opposite to one end side in which the concave portion 53 and the through hole 54 are formed, FIG. 1B shows as a part in the lower side) projects laterally from the female terminal housing 7 in top view.

A rotation operation of the lever 52 is carried out by pushing the projecting portion of the lever 52 by fingers or the like so as to rotate the lever 52 in the one rotation direction (in the counterclockwise direction). The lever 52 is formed so as to have a shape that a corner part located in a side of the other end part in the long side direction at the releasing position of the lever 52 and in a side of the flange 24 in the short side direction is cut obliquely, in order that fingers can be easily inserted between the flange 24 and the lever 52 and the lever 52 can be easily operated, and is formed so as to have a composition that an oblique part 56 cut obliquely is pushed by fingers or the like.

As shown in FIGS. 2A to 2C, at the fixing position, the lever 52 is formed so as to have a composition that the long side direction conforms to the fitting direction (FIG. 2 B shows as the left-right direction). Namely, the fixing position is such that the lever 52 is rotated by 90 degrees from the releasing position shown in FIGS. 1A to 1C in the one rotation direction (i.e., in the counterclockwise direction).

At the fixing position, the lever 52 is formed not to project laterally from the female terminal housing 7 in top view. Namely, in the embodiment, the lever 52 is formed to have a length of the short side direction shorter than a width of the tubular body 36 of the female terminal housing 7 (FIG. 2B shows as a length of the top-bottom direction). Due to this, at the fixing position, the lever 52 does not project laterally from the female terminal housing 7, so that the whole of the connector 1 can be downsized. In addition, it can be easily determined whether the lever 52 is positioned at the fixing position or the releasing position, due to the fact that the lever 52 projects laterally from the female terminal housing 7 or not.

And now, the lever mechanism 51 according to the embodiment includes an operation permitting means 60 that permits an operation to the connecting member 9 for collectively fixing a plurality of the first connecting terminals 4*a* to 4*c* and a plurality of the second connecting terminals 6*a* to 6*c* at each contact (namely, an operation for rotating the lever 52 from the releasing position to the fixing position), when the male terminal housing 5 and the female terminal housing 7 reach a predetermined fitting state, in case that the male terminal housing 5 and the female terminal housing 7 are fitted to each other.

The operation permitting means 60 includes a lever engaging rib 61 formed in the male terminal housing 5, a lance 58 formed in the lever 52, for engaging with the lever engaging rib 61 at the releasing position to prevent the lever 52 from rotating from the releasing position in the one rotation direction (i.e., in the counterclockwise direction) and an engagement releasing rib 62 formed in the female terminal housing 7, for pushing up the lance 58 engaged with the lever engaging rib 61, releasing the engagement between the lever engaging rib 61 and the lance 58, and permitting the operation for allowing the lever 52 to rotate from the releasing position to the fixing position in the one rotation direction (i.e., in the counterclockwise direction), when the male terminal housing 5 and the female terminal housing 7 are in the predetermined fitting state.

As shown in FIG. 10B, the lance 58 includes a tongue 58*a* formed in a rear surface side of the lever 52 along the long side direction and a projection 58*b* projecting downward (FIG. 10B shows as upward) from the forward end of the tongue 58*a*. The projection 58*b* of the lance 58 is formed so as to be located at a periphery of the one end part in the long side direction of the lever 52 (an end part in a side where the concave portion 53 and through hole 54 are formed). The lance 58 is formed so as to have a composition that when the projection 58*b* is pressed from a rear surface side to a front surface side of the lever 52 (from lower part to upper part), the tongue 58*a* is bent so that the projection 58*b* is moved upward.

Figure 11:
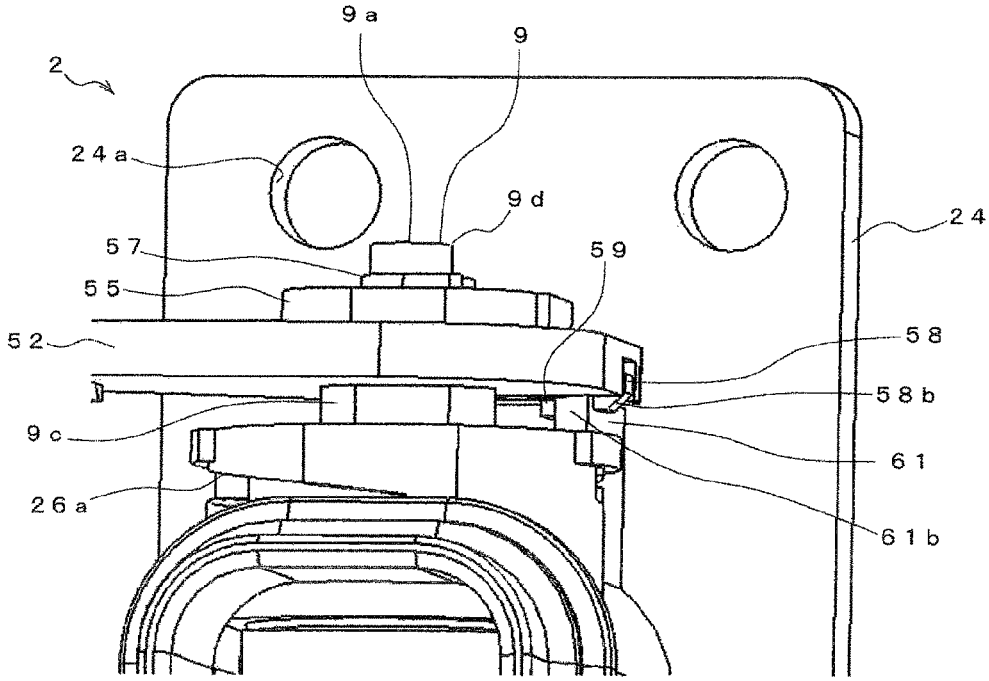
FIG. 11 is an enlarged side view of the essential parts of the first connector part shown in FIGS. 3A and 3B, explaining that a lance of the lever is engaged with a lever engaging rib when the lever is located at a releasing position.

As shown in FIGS. 5, 9 and 11, the lever engaging rib 61 includes a base end part 61*a* having a plate-like shape, integrally fixed to the flange 24 and the tubular member 20, and an engaging part 61*b* having a structure that an upper part (a part opposite to the tubular member 20) of the base end part 61*a* is extended in the fitting direction along the rear surface of the lever 52. The lever engaging rib 61 can be formed integrally with the flange 24 and the tubular member 20, or it can be also formed separately from them and then the base end part 61*a* is bonded to the flange 24 and the tubular member 20. As shown in FIG. 11, when the lever 52 is located at the releasing position, the projection 58*b* of the lance 58 is engaged with the engaging part 61*b* of the lever engaging rib 61.

As shown in FIGS. 9 to 12, the lever 52 has a first rotation preventing rib 59 formed therein, for coming into contact with the engaging part 61*b* of the lever engaging rib 61 at the releasing position so as to prevent the lever 52 from rotating from the releasing position in the other rotation direction (i.e., in the clockwise direction). The first rotation preventing rib 59 is formed so as to project from a rear surface side of the lever 52 along the short side direction, and comes into contact with the engaging part 61*b* opposite to a side with which the lance 58 is engaged when the lever 52 is located at the releasing position. Due to this, the engaging part 61*b* of the lever engaging rib 61 is shaped to be sandwiched between the lance 58 projecting from the rear surface side of the lever 52 and the first rotation preventing rib 59, so that the lever 52 is controlled so as not to rotate from the releasing position to any of the counterclockwise direction and the clockwise direction.

Figure 12:
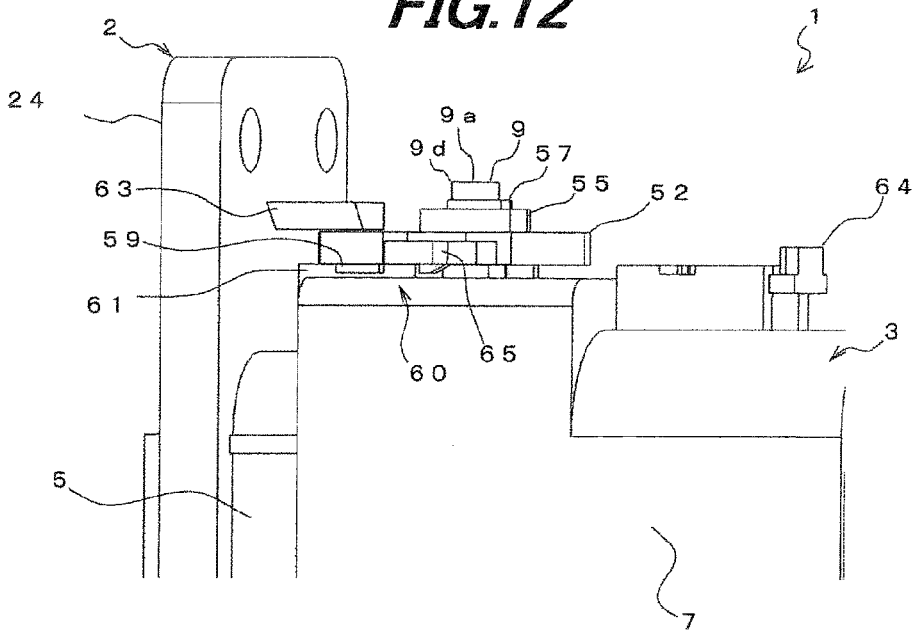
FIG. 12 is an enlarged side view of the essential parts of the connector shown in FIG. 1A.

In addition, in the connector 1 according to the embodiment, since the connecting member 9 disengages from the upper portion of the male terminal housing 5 at the releasing position, as a countermeasure against this, as shown in FIGS. 9 and 12, a disengagement preventing rib 63 for contacting a surface (i.e., a surface opposite to the male terminal housing 5) of the lever 52 so as to prevent the lever 52 and the connecting member 9 from disengaging from the male terminal housing 5 is formed in the male terminal housing 5. The disengagement preventing rib 63 is formed integrally with the flange 24 to project from a surface of the flange 24 on the side of the second connector part 3 (i.e., on the right-front side in FIG. 9). The disengagement preventing rib 63 has a tapered shape at a side part thereof (i.e., a side part on the left-front side in FIG. 9) so as not to interfere with the lever 52 when the lever 52 rotates from the fixing position to the releasing position.

As shown in FIGS. 6A and 6B, the engagement releasing rib 62 is formed on a periphery of the cutting region 40 formed in the tubular member 36 of the female terminal housing 7 along the fitting direction, and is formed integrally with the female terminal housing 7 so as to project upward from the female terminal housing 7. The engagement releasing rib 62 has a slope face 62*a* formed oblique at an end part thereof (i.e., an end part on the left side in FIG. 6B) in order to easily push up the lance 58. In addition, the engagement releasing rib 62 is formed so as to have a composition that a height (or a projection length) thereof becomes equal to or higher than that of the engaging part 61*b* of the lever engaging rib 61 when the male terminal housing 5 and the female terminal housing 7 are fitted to each other.

As shown in FIG. 9, a counter position assurance (CPA) 64 as a locking mechanism for fixing the lever 52 at the fixing position is formed in the female terminal housing 7. A fitting groove 65 into which the CPA 64 is fitted is formed in the lever 52, and the lever 52 is rotated so as to be located at the fixing position, and then the CPA 64 is pushed in a side of the lever 52, and the CPA 64 is fitted to the fitting groove 65, so that the lever 52 is locked at the fixing position (refer to FIG. 2A).

In addition, as shown in FIG. 9, a second rotation preventing rib 66 for contacting the lever 52 at the fixing position to prevent the lever 52 from rotating from the fixing position in the one rotation direction (i.e., in the counterclockwise direction) is formed in the female terminal housing 7. The second rotation preventing rib 66 is formed as a part (on the right-rear side in FIG. 9) of the CPA 64 projecting upward. The second rotation preventing rib 66 functions to control the lever 52 not to be rotated in excess and further facilitate alignment of the fitting groove 65 to the CPA 64 by contacting a side of the lever 52.

Fitting of First Connector Part and Second Connector Part

In a state that the first connector part 2 and the second connector part 3 are not fitted to each other, the lever 52 is located at the releasing position. At the releasing position, the lance 58 is engaged with the lever engaging rib 61 and the first rotation preventing rib 59 comes into contact with the lever engaging rib 61, so that the lever 52 is controlled so as not to be rotated in any of the counterclockwise direction and the clockwise direction.

When the first connector part 2 and the second connector part 3 are fitted to each other, each of the second connecting terminals 6*a* to 6*c* is inserted between each of the first connecting terminals 4*a* to 4*c* with which each of the second connecting terminals 6*a* to 6*c* forms a pair and each of the first insulation plates 8*a* to 8*c*. And, due to the insertion, each one surface of a plurality of the first connecting terminals 4*a* to 4*c* and each one surface of a plurality of the second connecting terminals 6*a* to 6*c* face each other so that they form a pair with each other, and simultaneously the first connecting terminals 4*a* to 4*c*, the second connecting terminals 6*a* to 6*c* and the insulation plates 8*a* to 8*d* are alternately arranged. Namely, a stacked state is formed, that the insulation plates 8*a* to 8*d* are arranged so as to sandwich the first connecting terminals 4*a* to 4*c* and the second connecting terminals 6*a* to 6*c* that form a pair with each other.

In this case, in the first connector part 2, each of the insulation plates 8*a* to 8*c* is fixed to the forward end side of the first connecting terminals 4*a* to 4*c* that are held in alignment with each other so as to be located apart at certain intervals, so that intervals among the first insulation plates 8*a* to 8*c* can be retained without separately installing a retention jig for retaining intervals among the first insulation plates 8*a* to 8*c* (refer to JP-B-4037199). Due to this, each of the second connecting terminals 6*a* to 6*c* can be easily inserted between each of the first connecting terminals 4*a* to 4*c* with which each of the second connecting terminals 6*a* to 6*c* forms a pair and the insulation plates 8*a* to 8*d*. Namely, insertion and removal properties of the second connecting terminals 6*a* to 6*c* are not be reduced. In addition, it is not necessary to install the retention jig for retaining intervals among the first insulation plates 8*a* to 8*c*, so that it is extremely effective in terms of being further downsized compared to the conventional technique.

In addition, the contact of the first connecting terminal 4*a* (or 4*b*) and the second connecting terminal 6*a* (or 6*b*) is sandwiched between the first insulation plate 8*a* (or 8*b*) fixed to the first connecting terminal 4*a* (or 4*b*) constituting the contact and the first insulation plate 8*b* (or 8*c*) fixed to the first connecting terminal 4*b* (or 4*c*) constituting the other contact. Similarly, the contact of the first connecting terminal 4*c* and the second connecting terminal 6*c* is sandwiched between the first insulation plate 8*c* fixed to the first connecting terminal 4*c* constituting the contact and the second insulation plate 8*d* fixed to the inner surface of the male terminal housing 5.

Figure 13A:
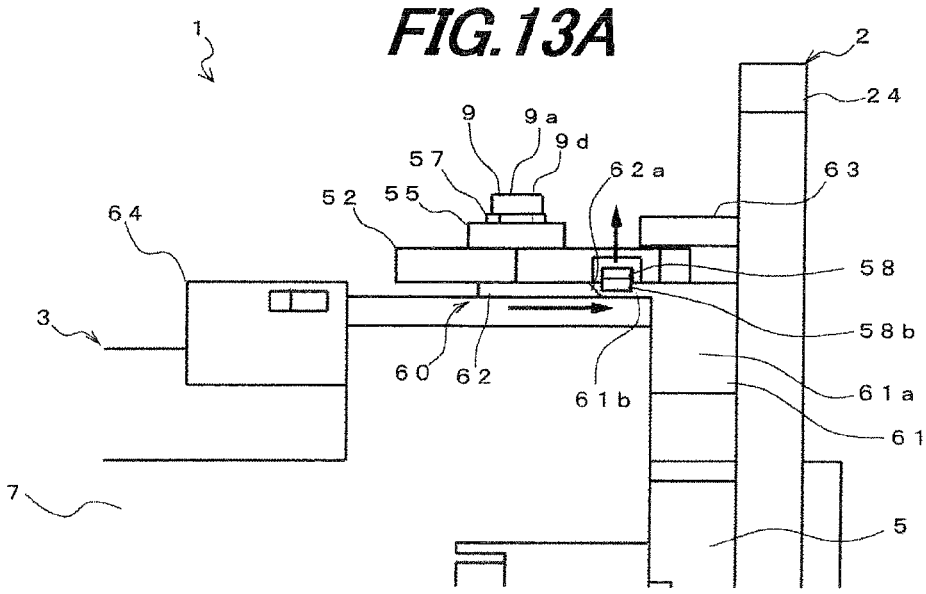
FIGS. 13A and 13B are enlarged side views of the essential parts of the connector shown in FIG. 1A, explaining a situation that an engagement releasing rib disengages between the lever engaging rib and the lance.
Figure 13B:
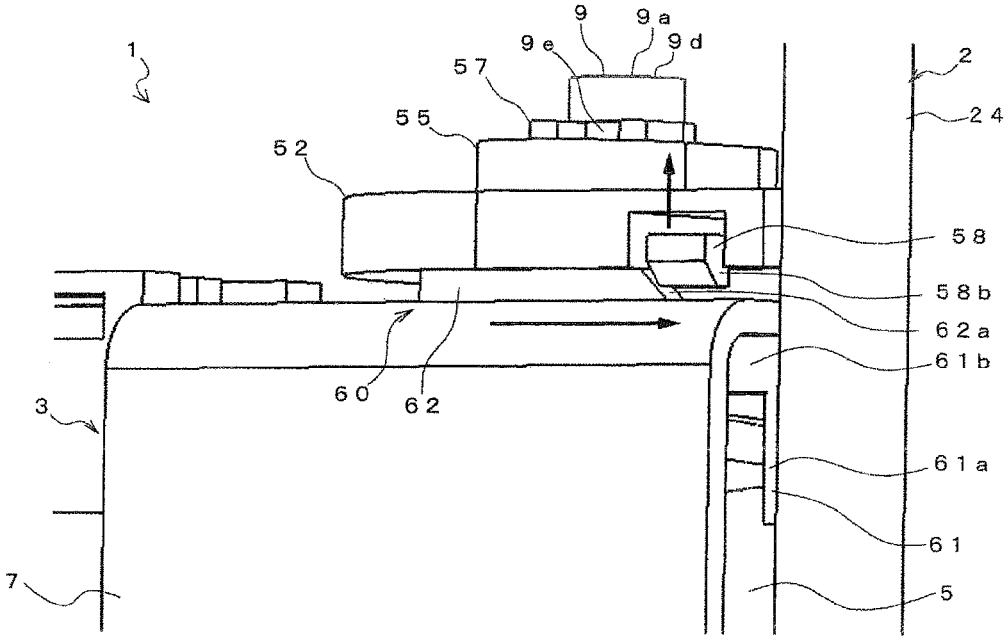

On the other hand, as shown in FIGS. 13A and 13B, when the male terminal housing 5 and the female terminal housing 7 are fitted to each other, the engagement releasing rib 62 moves along the engaging part 61*b* of the lever engaging rib 61 and lifts the projection 58*b* of the lance 58 upward by the slope face 62*a*. In addition, when the male terminal housing 5 and the female terminal housing 7 reach a predetermined fitting state, the projection 58*b* of the lance 58 is lifted further upward (higher than the engaging part 61*b* of the lever engaging rib 61) by the engagement releasing rib 62, so that the engagement between the lever engaging rib 61 and the lance 58 is released. Due to this, the lever 52 is permitted to be rotated from the releasing position to the one rotation direction (i.e., in the counterclockwise direction).

After that, the lever 52 is rotated by 90 degrees in the one rotation direction (i.e., in the counterclockwise direction) and the lever 52 is rotated from the releasing position to the fixing position (until it comes into contact with the second rotation preventing rib). Then, in accordance with this, the connecting member 9 is also rotated, and the projection 9*f* of the head part 9*b* is guided by the spiral groove 26*a*, so that the head part 9*b* is pushed interiorly while being rotated, simultaneously the first insulation plate 8*a*, the first insulation plate 8*b*, the first insulation plate 8*c* and the second insulation plate 8*d* are pressed in this order by the elastic member 15, each of the contacts is pressed so as to be sandwiched by any two of the insulation plates 8*a* to 8*d*, and each of the contacts is contacted in an insulated condition from each other. At this time, each of the first connecting terminals 4*a* to 4*c* and each of the second connecting terminals 6*a* to 6*c* are somewhat bent by the pressing of the insulation plates 8*a* to 8*d* and come into contact with each other in a wide area. Due to this, each of the contacts comes into contact with each other strongly so as to be fixed to each other firmly, even if it is located in an environment such as vehicles in which vibration is easily generated. After the lever 52 is located at the fixing position, the CPA 64 is fitted to the fitting groove 65 and the lever 52 is locked at the fixing position.

Further, in the embodiment, as shown in FIG. 2B, at the fixing position, the lever 52 disengages from the lower portion of the disengagement preventing rib 63, but when the lever 52 is rotated from the releasing position, the projection 9*f* formed in the head part 9*b* of the connecting member 9 engages with the spiral groove 26*a*, so that the lever 52 and the connecting member 9 can be prevented from disengaging from the male terminal housing 5.

EFFECTS OF THE EMBODIMENT

The effects of the embodiment will be explained below.

The connector 1 according to the embodiment includes the lever mechanism 51 having a lever 52 for allowing the head part 9*b* of the connecting member 9 to be rotated so as to allow the head part 9*b* of the connecting member 9 to press the first insulation plate 8*a* adjacent thereto, and the lever mechanism 51 includes the operation permitting means 60 that permits an operation to the connecting member 9 for collectively fixing a plurality of the first connecting terminals 4*a* to 4*c* and a plurality of the second connecting terminals 6*a* to 6*c* at each contact, when the male terminal housing 5 and the female terminal housing 7 reach a predetermined fitting state, in case that the male terminal housing 5 and the female terminal housing 7 are fitted to each other.

If the connecting member 9 is operated before the male terminal housing 5 and the female terminal housing 7 are completely fitted to each other, there is a possibility that the first connecting terminals 4*a* to 4*c* and the second connecting terminals 6*a* to 6*c* are not completely brought into contact with each other and contact failure is caused, but according to the connector 1 of the embodiment, a composition can be adopted, that in the incomplete fitting state, the operation for collectively fixing a plurality of the first connecting terminals 4*a* to 4*c* and a plurality of the second connecting terminals 6*a* to 6*c* at each contact (here, an operation for rotating the lever 52 from the releasing position to the fixing position) is not permitted, and each contact can not be pressed by the connecting member 9 except for the time when the first connecting terminals 4*a* to 4*c* and the second connecting terminals 6*a* to 6*c* are arranged so as to be located at a predetermined position with each other. Consequently, the connector 1 in which an electric connection failure is hardly caused can be realized.

In other words, the connector 1 is constructed such that the fastening operation of the connecting member 9 is not permitted when the fitting of the connector parts 2 and 3 is incomplete, and the fastening operation of the connecting member 9 is permitted only when the fitting of the connector parts 2, 3 is completed. Thereby, the connection failure between the first connecting terminals 4*a* to 4*c* and the second connecting terminals 6*a* to 6*c* can be prevented.

In addition, the connector 1 includes the first rotation preventing rib 59 formed in the lever 52, for contacting the lever engaging rib 61 at the releasing position to prevent the lever 52 from rotating from the releasing position in the other rotation direction (i.e., in the clockwise direction), and the second rotation preventing rib 66 formed in the female terminal housing 7, for contacting the lever 52 at the fixing position to prevent the lever 52 from rotating from the fixing position in the one rotation direction (i.e., in the counterclockwise direction), so that the lever 52 is prevented from rotating beyond the range from the releasing position to the fixing position, and disadvantages due to an excessive rotation of the lever 52 can be prevented.

In addition, the connector 1 includes the CPA 64 as a locking mechanism formed in the female terminal housing 7, for fixing the lever 52 at the fixing position, so that a disadvantage that the lever 52 is unintentionally rotated from the fixing position to the releasing position and the fastening of the connecting member 9 is loosened can be prevented.

In addition, the connector 1 uses a so-called cantilever type lever as the lever 52, that is formed of a plate-like member being rotated integrally with the connecting member 9 and is disposed in the one side of the male terminal housing 5 rotatably about the connecting member 9 as a rotation axis, so that an occupation space of the lever 52 can be reduced and the whole of the connector 1 can be downsized.

In addition, the connector 1 includes a disengagement preventing rib 63 formed in the male terminal housing 5, for coming into with a surface of the lever 52, so that the lever 52 and the connecting member 9 can be prevented from disengaging from the male terminal housing 5.

In addition, the connector 1 includes the concave portion 16 formed in an upper surface of the first insulation plate 8*a*, for covering (housing) the lower portion of the elastic member 15, and the concave portion 9*g* formed in a lower surface of the head part 9*b* of the connecting member 9, for housing the upper portion of the elastic member 15, so that a height of the elastic member 15 exposed between the first insulation plate 8*a* and the head part 9*b* can be reduced correspondingly to an amount being housed in the concave portions 16, 9*g* and the connector 1 can be downsized in comparison with conventional connectors. Namely, even if the connector 1 has a composition that the elastic member 15 for providing a pressing force is installed, slimming of the connector 1 can be realized.

In addition, the pressing force of the elastic member 15 is received by the receiving member 17 of metal formed in a bottom portion of the concave portion 16, so that it can be prevented that an excessive stress is applied to the first insulation plate 8*a* formed of resin, the excessive stress being caused by that the elastic member 15 comes into contact with the upper surface of the first insulation plate 8*a* in a small contact area and a possibility that the first insulation plate 8*a* is damaged can be reduced. Namely, reliability and durability of the connector can be further enhanced.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

For example, in the embodiment, a power line of three-phase alternating current is assumed, but according to the technical idea of the invention, a composition that a plurality of power lines different from each other in applications such as a power line of three-phase alternating current used for a connection between a motor and an inverter, a power line of two-phase direct current used for an air conditioner in a connector for vehicles are collectively connected to each other can be also adopted. Due to this composition, power lines for a plurality of applications can be collectively connected to each other by one connector, so that it is not necessary to prepare different connectors for the respective applications and it can contribute to space saving and cost reduction.

In addition, a composition that terminal surfaces of each of the first connecting terminals 4*a* to 4*c* and each of the second connecting terminals 6*a* to 6*c* are roughened by a knurling process or the like so as to increase a friction force and allow the terminals to hardly move with respect to each other, so that the fixing at each contact can be strengthened can be also adopted.

In addition, in the embodiment, a case that nothing is connected to one end sides of the first connecting terminals 4*a* to 4*c*, different from the case of the second connecting terminals 6*a* to 6*c* is explained, but not limited to this composition. Namely, the connector according to the invention can be used in a case that the cables are connected to each other.

In addition, in the embodiment, a cable excellent in flexibility is used as the cables 27*a* to 27*c*, but a cable that is rigid can be also used.

In addition, in the embodiment, with regard to a disposition of the connector in use situation, the connecting member 9 can be disposed to any of nearly horizontal situation and nearly perpendicular situation. Namely, the disposition in use situation is not included in use conditions to be required for the connector according to the invention.

In addition, in the embodiment, the first insulation plate 8*a* adjacent to the head part 9*b* is pressed by the head part 9*b* of the connecting member 9 via the elastic member 15 constituting a part of the connecting member 9, but a composition that the first insulation plate 8*a* adjacent to the head part 9*b* is directly pressed by the head part 9*b* not via the elastic member 15 can be also adopted.

What is claimed is:

1. A connector, comprising:

a male terminal housing with a plurality of first connecting terminals aligned and accommodated therein;

a female terminal housing with a plurality of second connecting terminals aligned and accommodated therein;

a plurality of insulation plates aligned and accommodated in the male terminal housing, wherein when the male terminal housing and the female terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of insulation plates;

a connecting member comprising a head, the head being adapted to press an adjacent one of the plurality of insulation plates for collectively fixing the plurality of first connecting terminals and the plurality of second connecting terminals at contacts for electrical connections between the plurality of first connecting terminals and the plurality of second connecting terminals, respectively; and a lever mechanism comprising a lever to rotate the head of the connecting member so as to press the head of the connecting member against the adjacent one of the plurality of insulation plates, wherein the lever mechanism further comprises an operation permitting means that permits the connecting member to collectively fix the plurality of first connecting terminals and the plurality of second connecting terminals at the contacts, when the male terminal housing and the female terminal housing come into a predetermined fitting state.

2. The connector according to claim 1, wherein the plurality of first connecting terminals and the plurality of second connecting terminals are collectively fixed at the contacts by rotating the lever from a releasing position to a fixing position in one rotation direction, and the operation permitting means comprises:

a lever engaging rib on the male terminal housing;

a lance on the lever to engage with the lever engaging rib at the releasing position so as to prevent the lever from rotating from the releasing position in the one rotation direction, when the male terminal housing and the female terminal housing are not in the predetermined fitting state; and an engagement releasing rib on the female terminal housing to push up the lance engaged with the lever engaging rib so as to release the engagement between the lever engaging rib and the lance to permit the lever to rotate from the releasing position to the fixing position in the one rotation direction, when the male terminal housing and the female terminal housing come into the predetermined fitting state.

3. The connector according to claim 2, wherein the lever comprises a first rotation preventing rib to contact the lever engaging rib at the releasing position so as to prevent the lever from rotating from the releasing position in an other rotation direction.

4. The connector according to claim 2, wherein the female terminal housing comprises a second rotation preventing rib to contact the lever at the fixing position so as to prevent the lever from rotating from the fixing position in the one rotation direction.

5. The connector according to claim 2, wherein the female terminal housing comprises a locking mechanism to fix the lever at the fixing position.

6. The connector according to claim 1, wherein the lever comprises a plate-like member to rotate integrally with the connecting member, and is disposed on one side of the male terminal housing rotatable around the connecting member as a rotation axis.

7. The connector according to claim 6, wherein the male terminal housing comprises a disengagement preventing rib to contact a surface of the lever opposite to the male terminal housing so as to prevent the lever and the connecting member from disengaging from the male terminal housing.

* * * * *